United States Patent [19]

Freadman

[11] Patent Number: 5,004,105

[45] Date of Patent: Apr. 2, 1991

[54] PACKAGING ARRANGEMENT FOR TRANSPORTING AUDIO SYSTEM COMPONENTS TO AND FROM AN OUTDOOR MARINE SITE

[76] Inventor: Tommyca Freadman, 16 Glen Dr., Goshen, N.Y. 10924

[21] Appl. No.: 495,261

[22] Filed: Mar. 16, 1990

[51] Int. Cl.[5] ..... B65D 85/30

[52] U.S. Cl. ..... 206/576; 206/320; 206/328; 220/4.27; 224/273; 455/346

[58] Field of Search ..... 206/305, 320, 328, 576; 220/4 D, 22.1, 22.2, 23.83, 23.86; 224/42.01, 273; 455/345–351

[56] References Cited

U.S. PATENT DOCUMENTS

| | | | |
|---|---|---|---|
| 2,855,257 | 10/1958 | Barker et al. | 455/351 |
| 2,878,375 | 3/1959 | Schachtel | 455/351 |
| 3,409,193 | 11/1968 | Metcalf | 224/273 |
| 4,006,764 | 2/1977 | Yamamoto et al. | 206/320 |
| 4,212,377 | 7/1980 | Weinreb | 190/110 |
| 4,706,810 | 11/1987 | Petrilli | 206/320 |
| 4,744,446 | 5/1988 | Arney | 150/111 |
| 4,802,589 | 2/1989 | Berg et al. | 220/4 D |
| 4,848,626 | 7/1989 | Waters | 224/273 |
| 4,896,360 | 1/1990 | Knight | 455/349 |
| 4,929,948 | 5/1990 | Holmberg | 190/110 |

*Primary Examiner*—Jimmy G. Foster
*Attorney, Agent, or Firm*—Jacobs & Jacobs

[57] ABSTRACT

A plurality of speakers and related audio system components are transported to and from an outdoor marine location by a packaging arrangement which includes a pair of weather-resistant carrying containers that are detachably secured. When secured together, the containers carrying their respective speakers are transported as an integrated cargo unit. When detached, each container carrying its respective speaker is independently transported as an individual cargo unit.

24 Claims, 3 Drawing Sheets

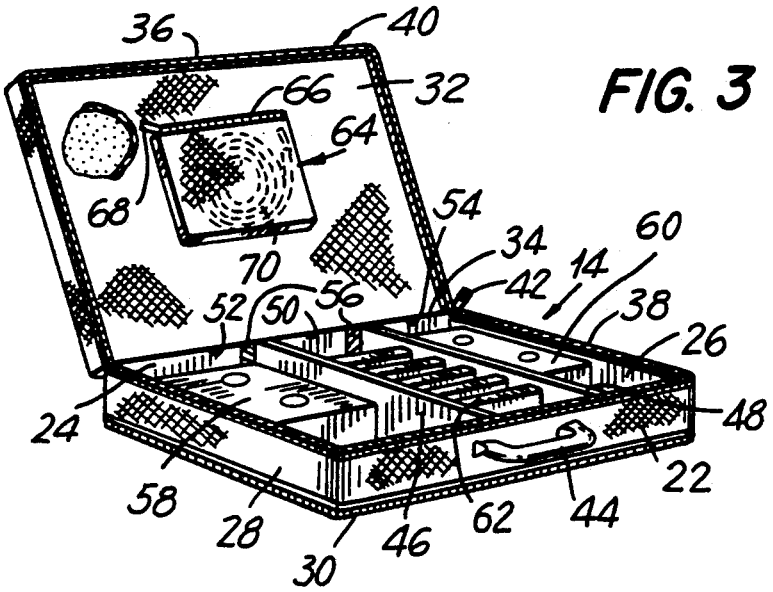
FIG. 3
FIG. 4
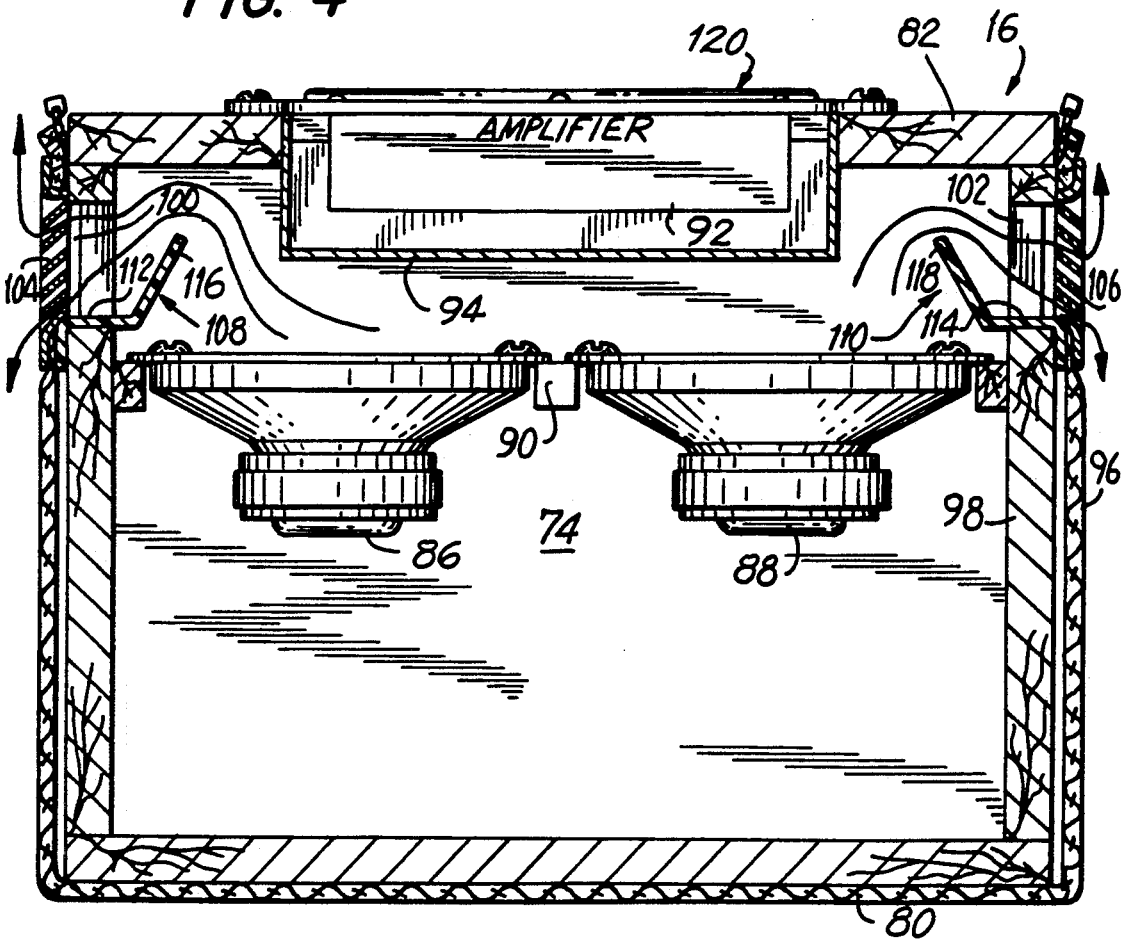

PACKAGING ARRANGEMENT FOR TRANSPORTING AUDIO SYSTEM COMPONENTS TO AND FROM AN OUTDOOR MARINE SITE

BACKGROUND OF THE INVENTION

1. Field of the Invention

This invention generally relates to a packaging arrangement for transporting audio system components to and from an outdoor marine site and, more particularly, for carrying audio speakers and related system accessories to and from a boat in carrying containers that are either secured together as an integrated cargo unit, or detached as individual cargo units.

2. Description of Related Art

Boaters wishing to hear programmed materials such as music on pre-recorded audio tapes, audio compact discs, audio cassettes and the like, often carry an indoor-type, portable audio system from their homes to their boats, and back again. However, such indoor systems are not designed to withstand the rigors of a marine environment and, if left exposed to the wind, rain, salt air and the like, become ruined over time To prevent such damage, many boaters have built-in sound systems equipped with exposed, outdoor, weather-resistant audio speakers.

However, theft is a major problem for on-board audio systems When portable systems are used, the entire audio system may be stolen. When built-in audio systems are used, the exposed outdoor speakers are often stolen. The outdoor speakers are often quite expensive in high-end, high-fidelity audio systems. Their replacement results in high economic loss and inconvenience.

SUMMARY OF THE INVENTION

1. Objects of the Invention

It is a general object of this invention to deter theft of on-board audio system components.

It is another object of this invention to conveniently carry selected audio system components such as speakers, cables, an amplifier, and related accessories in an integrated cargo unit to an outdoor marine location, and to conveniently remove at least some of said components for rapidly setting up an audio system at the marine location.

Another object of this invention is to conveniently carry one or more of said audio system components in individually separate cargo units away from the outdoor marine location to prevent loss of such components.

A further object of this invention is to conveniently carry such audio system components in a pair of containers detachably secured to each other.

Still another object of this invention is to resist moisture and like environmental hazards from coming into contact with electrical jacks, electrical plugs and the speakers.

Another object of this invention is to improve the sound quality of existing portable sound sources by connecting them to a high-fidelity speaker system.

Yet another object of this invention is to prevent damage to the audio system components being carried as a result of shocks encountered during transport.

A still further object of this invention is to provide a high-end, high-fidelity, marine-based, multispeaker audio system which is easily set up and disconnected.

2. Features of the Invention

In keeping with these objects, and others which will become apparent hereinafter, one feature of this invention resides, briefly stated, in a packaging arrangement for transporting audio system components to and from an outdoor site, particularly a marine location such as a boat.

The packaging arrangement comprises a pair of weather-resistant carrying containers, each having an interior. First speaker means, advantageously a pair of speakers, are removably mounted in the interior of one of the containers. Second speaker means, advantageously including at least one speaker, are mounted in the interior of the other of the containers.

According to this invention, detachable connector means are provided for securing the containers together for transport of both containers carrying their respective speaker means as an integrated caro unit to and from the site. The connector means is also operative for detaching the secured containers for independent transport of each detached container carrying its respective speaker means as an individual cargo unit to and from the site.

The first-mentioned container, which carries the first speaker means has a plurality of partitions removably mounted within and sub-dividing its interior to form individual storage compartments. Advantageously, the partitions sub-divide the interior into a central storage compartment, and a pair of side storage compartments at opposite sides of the central compartment. Each speaker is mounted in a respective side compartment for better balance of the first-mentioned container during transport. Audio tapes, audio compact discs, audio cassettes and the like are stored in the central compartment.

This container also includes a cover advantageously hingedly mounted thereon for movement between open and closed positions. A zipper fastener detachably secures the cover to its container.

This first-mentioned container also includes a pouch mounted on the cover. Audio cables, power cables, and like accessories may be stored in this pouch. Another zipper on the pouch helps secure the cables and related accessories therein.

The second-mentioned container, which carries another speaker, also advantageously carries a frequency cross-over network, an electrical amplifier, and a heat sink for conducting waste heat away from the amplifier. This other container has sound apertures, preferably covered by protective grilles. Sound from the second speaker means passes through these apertures. A splash guard is advantageously located within the other container adjacent each sound aperture. Each splash guard has an inclined baffle portion to deflect any water which may enter the other container through the sound apertures.

The aforementioned audio cables have plugs surrounded by weather-resistant sheaths or boots to prevent moisture, dirt and like environmental hazards from reaching audio input and audio output jacks provided on the amplifier. Similarly, a power cable having a power plug is provided for insertion into and removal from a power input jack on the amplifier. This power plug is also surrounded with a weather-resistant sheath.

The two containers are secured to each other in a stacked relationship, one above the other, along a vertical axis. Each container preferably has the same cross-sectional dimension as considered in a direction perpendicular to the vertical axis. The detachable connector means is an elongated slide fastener, e.g. a zipper, that extends circumferentially completely along peripheral borders of both containers.

Thus, with the two containers secured together and stacked one above the other, each container carrying its respective speaker means, the entire assembly may be transported as an integrated cargo unit to and from the boat. To assist such transport, a carrying strap may be provided on one of the containers. Thereupon, the two containers are detached The container carrying the first speaker means is opened, and the pair of speakers mounted therein are removed. The pouch is opened and the audio and power cables are removed. The power cable is connected between an on-board power supply and the amplifier The audio cables are connected between outputs on the amplifier and the first speakers. Additional audio cables are connected between inputs on the amplifier and an external sound source such as a radio, compact disc player, tape recorder, etc.

Should the boater wish to leave the boat unguarded, then the boater need only disconnect the first speakers and, perhaps, also the audio cables, and pack these speakers, the cables and the accessory tapes, discs and cassettes into the first-mentioned container. The first speakers and the tapes, discs and cassettes weigh the least, are the smallest in size, and are the most easily concealed and, hence, are the easiest and most valuable to steal. By carrying these most valuable parts of the system away from the boat, theft is deterred. A carrying handle is provided on this container to facilitate transport of its contents.

Upon the boater's return, the container is easily opened and its contents re-connected to the audio system.

Should the boater wish to leave the boat unguarded for an extended time, then, of course, both containers can be re-attached and both removed as an integrated unit away from the site. To prevent damage due to external shock during the transport of each or both containers, their respective walls are preferably provided with a padded, shock-absorbing material.

The first speaker means advantageously comprise a pair of speaker enclosures, each having a full range speaker therein, in which event, the second speaker means advantageously comprise a subwoofer. Alternatively, the first speaker means may advantageously comprise a pair of speaker enclosures, each having a midrange and a tweeter therein, in which event, the second speaker means advantageously comprises a woofer. Other combinations are, of course, within the scope of this invention. Together, the first and second speaker means cover the audio spectrum.

The novel features which are considered as characteristic of the invention are set forth in particular in the appended claims. The invention itself, however, both as to its construction and its method of operation, together with additioal objects and advantages thereof, will be best understood from the following description of specific embodiments when read in connection with the accompanying drawings.

BRIEF DESCRIPTION OF THE DRAWINGS

FIG. 3 is a front perspective view of one container of the arrangement of FIG. 1 in an open condition;

FIG. 4 is a view partly in section and partly in elevation of another container of the packaging arrangement of FIG. 1.

DETAILED DESCRIPTION OF THE PREFERRED EMBODIMENT

Figure 2:
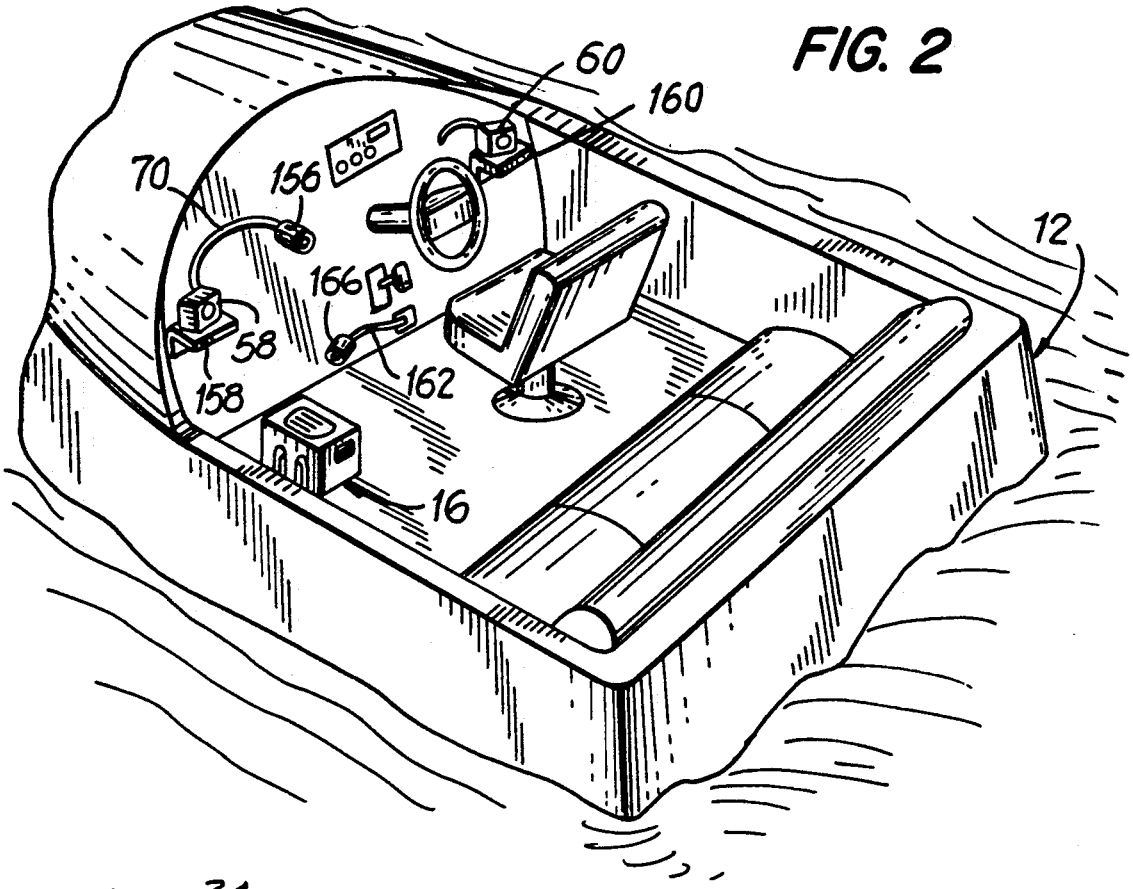
FIG. 2 is a partially broken-away, perspective view of some audio system components transported to a boat with the packaging arrangement of FIG. 1.
Figure 1:
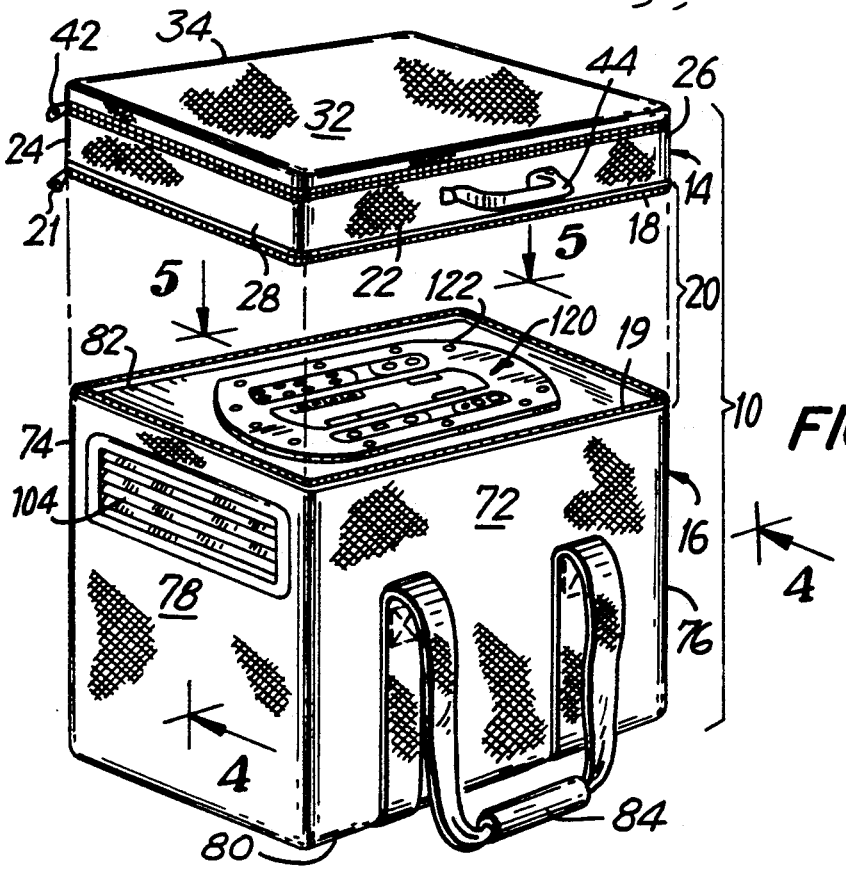
FIG. 1 is an exploded, front perspective view of a packaging arrangement according to this invention.

Referring now to FIGS. 1 and 2, reference numeral 10 generally identifies a packaging arrangement for transporting audio system components to and from an outdoor site, particularly a marine location such as a boat 12. The packaging arrangement 10 includes a pair of weather-resistant carrying containers, hereinafter termed upper container 14 and lower container 16, that is, the positions which the containers assume during their transport as an integrated unit. As will be described below, the carrying containers 14, 16 are secured together by detachable connector means 18, 19 which together comprise a first zipper 20 openable and closeable by a zipper pull 21. When the zipper 20 is closed, the two containers are interconnected for transport as an integrated cargo unit to and from the boat 12. When the zipper 20 is open, the two detachable containers 14, 16 are separately and independently transportable to and from the boat 12.

As best shown in FIG. 3, container 14 has a generally rectangular parallelepiped shape, and has a front wall 22, a back wall 24, a pair of end walls 26, 28, a bottom wall 30, and a top wall or cover 32 hinged for movement between an open position (FIG. 3) and a closed position (FIG. 1) in which access is permitted and denied respectively to the interior of upper container 14. The cover 32 is hinged along rear peripheral edge 34, and is fastened along its other three peripheral edges with one part 36 of a second zipper 40 whose other part 38 extends along upper peripheral edges of the walls 26, 22 and 28. A zipper pull 42 opens and closes the zipper 40. A carrying handle 44 mounted on the front wall 22 enables the upper container 14 to be individually carried.

A plurality of planar partitions 46, 48 are mounted within and sub-divide the interior of the container 14 to form a central storage compartment 50, and a pair of side storage compartments 52, 54 at opposite sides of the central compartment 50. Each partition is removably secured within the interior of the container 14 and, to that end, each partition has a pair of end flaps 56 overlaying portions of the front wall 22 and rear wall 24. The overlaying portions are provided with complementary detachable fasteners such as Velcro-type looped and hooked materials.

First audio speaker means are removably mounted in the interior of upper container 14. The first audio speaker means advantageously comprises a pair of speakers 58,60, each mounted in a respective side compartment 52, 54 for better balance of the upper container 14 during its transport as an individual cargo unit, or as an integrated cargo unit with the lower container 16. Audio tapes, audio compact discs, audio cassettes and related audio system accessories 62 are conveniently stored in the central storage compartment 50.

A pouch 64 is mounted on the inner side of the cover 32, and has an upper open end which is openable and closeable by another zipper 66 with the aid of a zipper pull 68. Audio cables 70 are conveniently stored in the pouch 64.

The aforementioned walls of upper container 14 are preferably provided with a shock-absorbing padding to protect the speakers 58, 60, the accessories 62, and the cables 70 from impacts normally encountered during transport.

Turning now to FIGS. 1 and 4, the lower container 16 also has a generally rectangular parallelepiped shape, and includes a front wall 72, a rear wall 74, a pair of end walls 76, 78, a bottom wall 80, and a top wall 82. When the upper container 14 is connected to the lower container 16, the top walls 22, 72 are co-planar, the rear walls 24, 74 are co-planar, the end walls 26, 76 are co-planar, the opposite end walls 28, 78 are co-planar, the base walls 30 and 80 lie in parallel planes, and the top walls 32, 82 also lie in parallel planes. Put another way, the cross-sectional dimensions of both containers, as considered in a direction perpendicular to a vertical axis, are the same. The walls of the lower container 16 are similarly constituted of a shock-absorbing, padding material. A carrying strap, preferably a shoulder strap 84, enables one to carry either the lower container 16 as an individual cargo unit or, together with upper container 14, as an integrated cargo unit.

Second audio speaker means are mounted in the interior of the lower container 16. Advantageously, the second audio speaker means includes at least one speaker, and preferably a pair of speakers 86, 88, a frequency cross-over network 90, an electrical amplifier 92, and a heat sink 94 for conducting waste heat away from the amplifier. Electrical interconnections have not been illustrated in FIG. 4 in order not to obscure the invention. Such electrical interconnections are conventional for those skilled in the art.

The lower container 16, as best shown in FIG. 4, has an outer jacket 96 made of a cushioning material, and an inner frame 98 made of a rigid material. A pair of sound apertures 100, 102 extend through the jacket 96 and frame 98 to permit sound waves issuing from the speakers 86, 88 to pass to the exterior of the lower container 16. Protective grilles or louvres 104, 106 overlay the apertures 100, 102 to shield the speakers. Splash guards 108, 110 are located within the interior of the frame 98 adjacent the sound apertures 100, 102, and prevent water from reaching the speakers. Each splash guard includes a generally planar mounting portion 112, 114 extending generally perpendicular to the respective vertical planes in which the apertures 100, 102 lie, and inclined baffle portions 116, 118 extending away from the respective planes and into the interior of the lower container 16. The baffle portions 116, 118 are situated between the sound apertures 100, 102 and the speakers 86, 88, and permit the aforementioned sound waves to pass to the exterior of the lower container 16 in the direction of the illustrated arrows.

Figure 5:
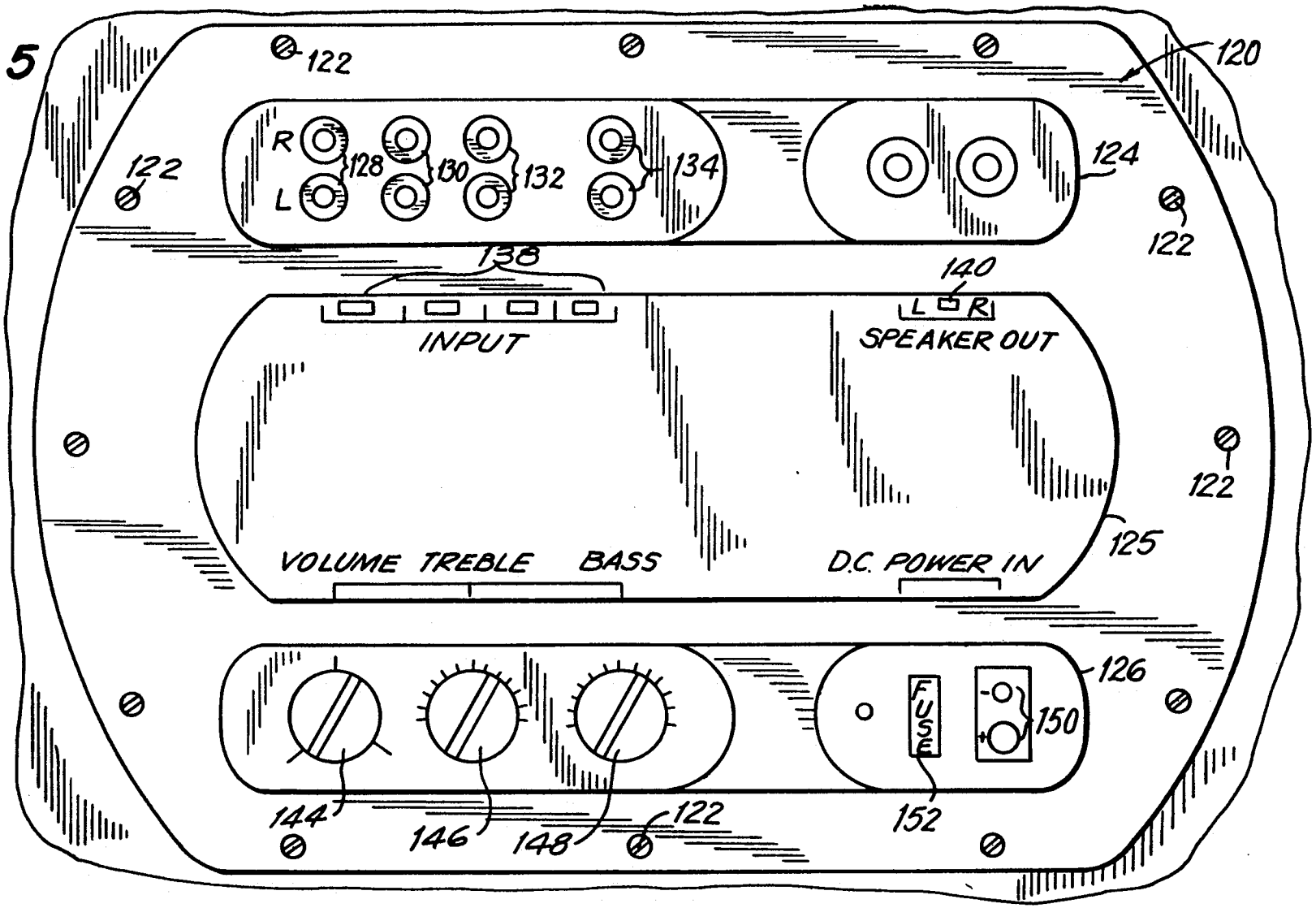
FIG. 5 is an enlarged, top plan view of a control panel on the top of the container of FIG. 4.

Turning now to FIG. 5, the amplifier 92 has a face plate 120 bolted to the frame 98 by means of bolts 122 arranged around the periphery of the face plate 120. Face plate 120 has three access openings 124, 125, 126. Access opening 124 accommodates a pair of right and left channel audio input jacks 128, tape input jacks 130, compact disc input jacks 132, and phonograph input jacks 134. Access opening 124 also accommodates left and right channel audio output jacks 136.

Access opening 125 accommodates four indicator lamps 138 adjacent each aforementioned pair of input jacks to visually indicate which input has been selected for use, as well as indicator lamp 140 to visually indicate that the output jacks 136 have been selected. Access opening 125 also contains another indicator lamp 142 to indicate that the amplifier has been turned on, as well as graphics for amplifier operation and ease of use.

Access opening 126 accommodates a volume-on/off control switch 144, a treble control knob 146, and a bass control knob 148. Access opening 126 also accommodates positive and negative power input jacks 150, as well as a fuse 152.

A sound source, such as a radio, tape player compact disc player, phonograph, or the like, either carried on board or already built into the boat, is selected and connected by audio cables 70 to an appropriate pair of audio input jacks on the amplifier. The output jacks 136 are connected by audio cables 70 to the aforementioned speakers 58, 60. The power input jacks 150 are connected by a power cable 162 to an on-board power supply such as the boat battery. Each one of the aforementioned cables is made weather-resistant by providing a weather-resistant sheath or boot surrounding respective plugs of the cables. The boot prevents dirt, moisture and like environmental hazards from reaching the jacks and ruining the electrical equipment. A representative audio cable 70 is illustrated in FIG. 2 as having a plug 154 surrounded by a boot 156. The power cable 162 having a power plug 164 is also surrounded by a weather-resistant sheath 166 and is also stored in pouch 64.

Returning to FIG. 1, the upper container 14 carries the first speakers, sound accessories and cables, while the lower container 16 carries the second speakers, crossover network, amplifier and protective members. When the two containers are secured together by interconnecting zipper parts 18, 19, the two containers with their contents may be carried by the shoulder strap 84 as an integrated cargo unit to the boat 12. Upon arriving at the boat, one need only open the zipper 20 by sliding the zipper pull 21 to separate the two containers. Container 16 may be placed anywhere on the boat deck. Of course, the controls should be placed within ready access of an operator.

As for the upper container 14, upon opening the zipper 40 and tilting back the cover 32, the speakers therein may be removed and installed anywhere on the boat. For example, FIG. 2 shows the speakers 58, 60 mounted on opposite sides of the boat, for better stereo sound separation, on separate shelves 158, 160. Once the speakers 58, 60 have been deployed and interconnected with a sound source, the upper container 14 may be stowed.

Should the boat operator wish to leave the boat unguarded for a time, but not wish to leave the first speakers and the sound accessories such as the audio tapes, discs and cassettes unprotected, then the operator need only pack the upper container 14 with these components and keep them by his or her side until he or she returns to the boat, where they may again be quickly installed in the audio system.

An important aspect of this invention is that an existing portable radio similar to those currently marketed under the trade name "Walkman", an existing portable compact disc player similar to those currently marketed under the mark "Discman", an existing portable tape cassette player, or the like, can be hooked up to the powered speaker system described herein to improve the overall fidelity of the sound of such existing sound sources.

The first speaker means advantageously comprise a pair of speaker enclosures, each having a full range speaker therein, in which event, the second speaker means advantageously comprise a subwoofer. Alternatively, the first speaker means may advantageously comprise a pair of speaker enclosures, each having a midrange and a tweeter therein, in which event, the second speaker means advantageously comprises a woofer. Other combinations are, of course, within the scope of this invention. Together, the first and second speaker means cover the audio spectrum It will be understood that each of the elements described above, or two or more together, also may find a useful application in other types of constructions differing from the types described above.

While the invention has been illustrated and described as embodied in a packaging arrangement for transporting audio system components to and from an outdoor marine site, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A packaging arrangement for transporting audio system components to and from an outdoor site, particularly a marine location, comprising:

(a) a pair of weather-resistant carrying containers, each having an interior;

(b) a first sound-transmitting speaker removably mounted in the interior of one of the containers;

(c) a second sound-transmitting speaker mounted in the interior of the other of the containers; and (d) detachable connector means for securing the containers together for transport of both containers carrying their respective speakers as an integrated cargo unit to and from the site, and for detaching the secured containers for independent transport of each detached container carrying its respective speaker as an individual cargo unit to and from the site, said detachable connector means including connector portions engaging each other when the containers are secured together, and disengaged apart from each other when the containers are detached.

2. The packaging arrangement according to claim 1, wherein said one container has a plurality of partitions mounted within and sub-dividing, the interior of said container to form individual storage compartments.

3. The packaging arrangement according to claim 1, wherein each container has a generally parallelepiped shape.

4. The packaging arrangement according to claim 1, wherein each container has padded, shock-absorbing walls.

5. The packaging arrangement according to claim 1; and further comprising another first sound-transmitting speaker mounted in the interior of said one container.

6. The packaging arrangement according to claim 1; and further comprising another second sound-transmitting speaker mounted in the interior of said other container.

7. The packaging arrangement according to claim 1, wherein said other container has a sound aperture through which sound transmitted by the second speaker passes.

8. The packaging arrangement according to claim 1, wherein each container has a circumferentially-complete peripheral border, and wherein each connector portion extends circumferentially completely along each border.

9. The packaging arrangement according to claim 1, wherein the connector portions secure the containers together in a stacked relationship, one above the other, along a vertical axis.

10. The packaging arrangement according to claim 9, wherein each container has the same cross-sectional dimension, as considered in a direction perpendicular to the vertical axis.

11. A packaging arrangement for transporting audio system components to and from an outdoor site, particularly a marine location, comprising:

(a) a pair of weather-resistant carrying containers, each having an interior, one of the containers having a plurality of partitions removably mounted within, and subdividing, the interior of said one container to form individual storage compartments;

(b) a first sound-transmitting speaker removably mounted in the interior of said one container;

(c) a second sound-transmitting speaker mounted in the interior of the other of the containers; and (d) detachable connector means for securing the containers together for transport of both containers carrying their respective speakers as an integrated cargo unit to and from the site, and for detaching the secured containers for independent transport of each detached container carrying its respective speaker as an individual cargo unit to and from the site.

12. A packaging arrangement for transporting audio system components to and from and outdoor site, particularly a marine location, comprising:

(a) a pair of weather-resistant carrying containers, each having an interior, one of the containers having a plurality of partitions mounted within, and sub-dividing, the interior of said one container to form individual storage compartments, said partitions sub-dividing the interior of said one container into a central storage compartment and a pair of side storage compartments at opposite sides of the central compartment;

(b) a pair of first sound-transmitting speakers removably mounted in the interior of said one container, each first speaker being mounted in a respective side compartment for better balance of said one container during transport;

(c) a second sound-transmitting speaker mounted in the interior of the other of the containers; and (d) detachable connector means for securing the containers together for transport of both containers carrying their respective speakers as an integrated cargo unit to and from the site, and for detaching the secured containers for independent transport of each detached container carrying its respective speaker as an individual cargo unit to and from the site.

13. The packaging arrangement according to claim 12, wherein the central storage compartment has an access opening through which audio tapes, audio compact discs and audio cassettes pass for storage in the central compartment.

14. A packaging arrangement for transporting audio system components to and from and outdoor site, particularly a marine location, comprising:

(a) a pair of weather-resistant carrying containers, each having an interior, one of the containers including a cover mounted for movement between open and closed positions in which access is permitted and denied respectively, and a pouch mounted on the cover and having an access opening through which cables pass for storage in the pouch;

(c) a first sound-transmitting speaker removably mounted in the interior of said one container;

(c) a second sound-transmitting speaker mounted in the interior of the other of the containers; and (d) detachable connector means for securing the containers together for transport of both containers carrying their respective speakers as an integrated cargo unit to and from the site, and for detaching the secured containers for independent transport of each detached container carrying its respective speaker as an individual cargo unit to and from the site.

15. The packaging arrangement according to claim 14, wherein the cover is hinged along one peripheral edge to said one container and is fastened thereto along its other peripheral edges with a fastener, and wherein the access opening of the pouch is fastened to the cover with another fastener.

16. A packaging arrangement for transporting audio system components to and from an outdoor site, particularly a marine location, comprising:

(a) a pair of weather-resistant carrying containers, each having an interior and a carrying handle;

(b) a first sound-transmitting speaker removably mounted in the interior of one of the containers;

(c) a second sound-transmitting speaker mounted in the interior of the other of the containers; and (d) detachable connector means for securing the containers together for transport of both containers carrying their respective speakers as an integrated cargo unit to and from the site, and for detaching the secured containers for independent transport of each detached container carrying its respective speaker as an individual cargo unit to and from the site.

17. A packaging arrangement for transporting audio system components to and from an outdoor site, particularly a marine location, comprising:

(a) a pair of weather-resistant carrying containers, each having an interior;

(b) a first sound-transmitting speaker removably mounted in the interior of one of the containers;

(c) a pair of second sound-transmitting speakers, a frequency cross-over network, an electrical amplifier and means for conducting waste heat away from the amplifier, all mounted in the interior of the other of the containers; and (d) detachable connector means for securing the containers together for transport of both containers carrying their respective speakers as an integrated cargo unit to and from the site, and for detaching the secured containers for independent transport of each detached container carrying its respective speaker as an individual cargo unit to and from the site.

18. A packaging arrangement for transporting audio system components to and from an outdoor site, particularly a marine location, comprising:

(a) a pair of weather-resistant carrying containers, each having an interior;

(b) a first sound-transmitting speaker removably mounted in the interior of one of the containers;

(c) a second sound-transmitting speaker mounted in the interior of the other of the containers, said other container having a sound aperture through which sound transmitted by the second speaker passes, and a protective grille overlaying the sound aperture; and (d) detachable connector means for securing the containers together for transport of both containers carrying their respective speakers as an integrated cargo unit to and from the site, and for detaching the secured containers for independent transport of each detached container carrying its respective speaker as an individual cargo unit to and from the site.

19. A packaging arrangement for transporting audio system components to and from an outdoor site, particularly a marine location, comprising:

(a) a pair of weather-resistant carrying containers, each having an interior;

(b) a first sound-transmitting speaker removably mounted in the interior of one of the containers;

(c) a second sound-transmitting speaker mounted in the interior of the other of the containers, said other container having a sound aperture through which sound transmitted by the second speaker passes, and a splash guard located within the interior of said other container adjacent the sound aperture; and (d) detachable connector means for securing the containers together for transport of both containers carrying their respective speakers as an integrated cargo unit to and from the site, and for detaching the secured containers for independent transport of each detached container carrying its respective speaker as an individual cargo unit to and from the site.

20. The packaging arrangement according to claim 19, wherein the sound aperture lies in a plane, and wherein the splash guard has a mounting portion extending generally perpendicular to said plane, and an inclined baffle portion extending away from said plane and into the interior of said other container.

21. A packaging arrangement for transporting audio system components to and from an outdoor site, particularly a marine location, comprising:

(a) a pair of weather-resistant carrying containers, each having an interior;

(b) a first sound-transmitting speaker removably mounted in the interior of one of the containers;

(c) a pair of second sound-transmitting speakers, a frequency cross-over network, an electrical amplifier and means for conducting waste heat away from the amplifier, all mounted in the interior of the other of the containers, said amplifier having audio input and audio output jacks;

(d) a set of audio cables having plugs for insertion into, and removal from, the jacks, each plug having a weather-resistant sheath to prevent moisture, dirt and like environmental hazards from reaching the jacks; and (e) detachable connector means for securing the containers together for transport of both containers carrying their respective speakers as an integrated cargo unit to and from the site, and for detaching the secured containers for independent transport of each detached container carrying its respective speaker as an individual cargo unit to and from the site.

22. The packaging arrangement according to claim 21, wherein the amplifier has a display for visually indicating which of the audio input jacks has been selected.

23. A packaging arrangement for transporting audio system components to and from an outdoor site, particularly a marine location, comprising:

(a) a pair of weather-resistant carrying containers, each having an interior;

(b) a first sound-transmitting speaker removably mounted in the interior of one of the containers;

(c) a pair of second sound-transmitting speakers, a frequency cross-over network, an electrical amplifier and means for conducting waste heat away from the amplifier, all mounted in the interior of the other of the containers, said amplifier having a power input jack;

(d) a power cable having a power plug for insertion into, and removal from the power jack, each plug having a weather-resistant sheath to prevent moisture, dirt and like environmental hazards from reaching the power jack; and (e) detachable connector means for securing the containers together for transport of both containers carrying their respective speakers as an integrated cargo unit to and from the site, and for detaching the secured containers for independent transport of each detached container carrying its respective speaker as an individual cargo unit to and from the site.

24. A packaging arrangement for transporting audio system components to and from an outdoor site, particularly a marine location, comprising:

(a) a pair of weather-resistant carrying containers, each having an interior and a circumferentially-complete peripheral border;

(b) a first sound-transmitting speaker removably mounted in the interior of one of the containers;

(c) a second sound-transmitting speaker mounted in the interior of the other of the containers; and (d) detachable connector means for securing the containers together for transport of both containers carrying their respective speakers as an integrated cargo unit to and from the site, and for detaching the secured containers for independent transport of each detached container carrying its respective speaker as an individual cargo unit to and from the site, said detachable connector means being an elongated slide fastener that extends circumferentially completely along each border.

* * * * *